US005885929A

United States Patent [19]

Brock et al.

[11] Patent Number: 5,885,929

[45] Date of Patent: Mar. 23, 1999

[54] REUSABLE DONOR LAYER CONTAINING DYE WELLS FOR THERMAL PRINTING

[75] Inventors: George W. Brock, La Jolla; Jeremiah F. Connolly, San Diego, both of Calif.; Charles D. DeBoer, Palmyra, N.Y.

[73] Assignee: Eastman Kodak Company, Rochester, N.Y.

[21] Appl. No.: 877,387

[22] Filed: Jun. 17, 1997

[51] Int. Cl.[6] ..... B41M 5/035; B41M 5/38

[52] U.S. Cl. ..... 503/227; 428/173; 428/195; 428/209; 428/694 R; 428/913; 428/914

[58] Field of Search ..... 8/471; 428/195, 428/304.4, 913, 914, 173, 209, 692, 694 R; 503/227

[56] References Cited

U.S. PATENT DOCUMENTS

| | | | |
|---|---|---|---|
| 4,414,555 | 11/1983 | Becker | 346/76 PH |
| 4,504,840 | 3/1985 | Evans et al. | 346/76 PH |
| 4,661,393 | 4/1987 | Uchiyama et al. | 428/200 |
| 4,663,216 | 5/1987 | Toyoda et al. | 428/212 |
| 4,695,288 | 9/1987 | Ducharme | 8/471 |
| 4,713,281 | 12/1987 | Shini | 428/207 |
| 4,737,486 | 4/1988 | Henzel | 503/227 |
| 4,865,913 | 9/1989 | Takeuchi et al. | 428/321.3 |
| 4,894,283 | 1/1990 | Wehr | 428/341 |
| 5,043,318 | 8/1991 | Kawakami et al. | 503/227 |
| 5,090,828 | 2/1992 | Shimura et al. | 400/197 |
| 5,118,657 | 6/1992 | Kawakami et al. | 503/227 |
| 5,137,382 | 8/1992 | Miyajima | 400/202.4 |
| 5,286,521 | 2/1994 | Matsuda et al. | 427/146 |
| 5,334,574 | 8/1994 | Matsuda et al. | 503/227 |
| 5,347,344 | 9/1994 | Itoh | 355/200 |
| 5,376,619 | 12/1994 | Mochizuki et al. | 503/227 |
| 5,397,637 | 3/1995 | Asami et al. | 428/323 |

*Primary Examiner*—Bruce H. Hess
*Attorney, Agent, or Firm*—William F. Noval

[57] ABSTRACT

A reusable thermal dye donor element for a dye transfer thermal printer comprising: a base layer; and a donor layer on said base layer, said donor layer having a plurality of wells which preferentially adsorb and desorb dye into said wells.

13 Claims, 3 Drawing Sheets

REUSABLE DONOR LAYER CONTAINING DYE WELLS FOR THERMAL PRINTING

FIELD OF THE INVENTION

This invention relates generally to thermal dye transfer printers and relates more particularly to such printers having a reusable dye donor member.

BACKGROUND OF THE INVENTION

As illustrated in FIG. 1, the major components of a thermal dye transfer printing system are:

1. The print head 10, which contains an array of discrete resistors to supply heat or electrodes to provide current with the heat generation via Joule heating.
2. The donor sheet 12 which consists of a thin base film carrying a dye material on one side and a slip layer on the side sliding against the print head. For Joule heating in the belt, a current return layer is required. The base has to be electrically conductive. Sheet 12 is fed between donor supply 11 and donor take-up 13.
3. A receiver material 14 (such as paper or transparency) in intimate contact with the dye side of the donor sheet.
4. A platen roller 16 required to form an intimate contact nip between the print head, the dye donor and image receiver, to enable transfer of the dye from the donor to the receiver, when the pulsed heat is generated either in the ribbon 12 or the print head 10.

FIG. 2 shows resistive ribbon printing where electrodes 18 inject current into the donor ribbon 20 where it heats the ink 22 and transfers it to the receiver 24.

A significant problem in this technology is that the dye donor members used to make the thermal prints are generally intended for single (one time) use. Thus, although the member has at least three times the area of the final print and contains enough dye to make a solid black image, only a small fraction of this dye is ever used.

After printing an image, the dye donor member cannot be easily reused, although this has been the subject of several patents. The primary reason that inhibits reuse of the dye donor members is that the dye transfer process is very sensitive to the concentration of dye in the donor layer. During the first printing operation, dye is selectively removed from the layer thus altering its concentration. In subsequent printings, regions of the donor member which had been previously imaged have a lower transfer efficiency than regions which were not imaged. This results in a ghost image appearing in subsequent prints.

The cost associated with having a single use donor ribbon is large because of the large area of ribbon required, as well as the large excess of dye remaining coated on the donor member. While this technology is able to produce high quality continuous tone color prints, it is desired to provide an approach which has all of the good attributes of thermal dye transfer imaging but without the limitations associated with single use donor members.

Some work has been done by others to accomplish similar goals. For example, U.S. Pat. No. 5,286,521 discusses a reusable wax transfer ink donor ribbon. This process is intended to provide a dye donor ribbon that may be used to print more than one page before the ribbon is completely consumed. U.S. Pat. No. 4,661,393 describes a reusable ink ribbon, again for wax transfer printing. The ink ribbon contains fine inorganic particles and low melting waxy materials to assist in the repeated use of this ribbon. U.S. Pat. No. 5,137,382 discloses a printer device capable of re-inking a thermal transfer ribbon. However, again the technology is wax transfer rather than dye transfer. In the device, solid wax is melted and transferred using a roller onto the reusable transfer ribbon.

U.S. Pat. No. 5,334,574 describes a reusable dye donor ribbon for thermal dye transfer printing. This reusable ribbon has multiple layers containing dye which limit the diffusion of dye out of the donor sheet. This enables the ribbon to be used to make multiple prints. In addition, the ribbon may be run at a slower speed than the dye receiver sheet, enabling additional utilization. U.S. Pat. No. 5,118,657 describes a multiple use thermal dye transfer ink ribbon. This ribbon has a high concentration dye layer on the bottom and a low concentration dye layer on the top. The low concentration dye layer meters or controls dye transfer out of the ribbon. This enables the ribbon to be used multiple times. U.S. Pat. No. 5,043,318 is another example of a thermal dye transfer ribbon which can be used multiple times.

U.S. Pat. No. 5,090,828 discloses a dielectric transfer technology for replenishing a donor sheet with small toner-like particles, filling in the regions where mass has been transferred from the ribbon.

U.S. Pat. No. 4,713,281 describes a multiple use pressure sensitive transfer recording medium.

U.S. Pat. No. 4,894,283 relates to a reusable thermal mass transfer ribbon consisting of carbon black, hydrocarbon wax and a thermal plastic resin.

U.S. Pat. No. 4,865,913 shows to a multiple use thermal mass transfer ink sheet, having an ink holding, porous membrane layer filled with hot melt ink.

U.S. Pat. No. 5,376,619 teaches a thermal dye transfer process in which a donor ribbon may be run at a slower speed than a receiver, thus generating a greater utilization of the donor ribbon.

U.S. Pat. No. 5,347,344 describes an electro-photographic type process, in which waxy toner particles are transferred in an image-wise fashion onto a reusable donor ribbon. The donor ribbon then subsequently transfers the toner image onto a receiver sheet using a thermal print head.

U.S. Pat. No. 4,504,840 discloses a reusable ribbon which is re-inked after printing by transferring wax transfer type colorant back to the ribbon in the liquid state. This method also discloses the use of a resistive ribbon type printing technology.

U.S. Pat. No. 4,414,555 relates to a process in which a mass transfer type printing ribbon is used to transfer an image to a receiving sheet. The used ribbon is then re-inked in this process, enabling it to be reused.

Accordingly, none of these disclosures directly relate to the concept of the re-application of dye to a dye donor ribbon. Techniques have been used in wax transfer printing to replenish a used donor ribbon. However, in such techniques, a mass transfer of wax back onto the donor sheet is used, rather than a re-diffusion of dye back into the donor layer. Similarly, the concept of replenishing a resistive ribbon thermal transfer sheet has been disclosed, but again only in the context of wax transfer imaging. There are several disclosures for reusable thermal dye transfer ribbons. However, these ribbons attempt to control the diffusion of dye out of the ribbon so that they could print multiple times, rather than replenishment of the dye in a dye donor element.

SUMMARY OF THE INVENTION

According to the present invention, there is provided a solution to the needs discussed above.

According to an aspect of the present invention, there is provided a reusable thermal dye donor element for a dye transfer thermal printer comprising a base layer, and a donor layer on said base layer, said donor layer having a plurality of wells which preferentially adsorb and desorb dye into said wells.

According to another aspect of the present invention, there is provided a thermal dye transfer printing system comprising: a reusable thermal dye donor element including a base layer and a donor layer on said base layer, said donor layer having a plurality of wells which preferentially adsorb and desorb dye into and out of said wells; a printing station at which dye is image-wise transferred from said dye donor element to a receiver medium, at least partially depleting the dye donor element of dye; and a dye replenishment station for replenishing dye which has been depleted from said donor element wells.

ADVANTAGES

The invention has the following advantages.

1. The dye donor element in a thermal printing system can be reused, reducing cost and complexity of the system.
2. Environmental issues are minimized by a significant reduction in waste product.

DETAILED DESCRIPTION OF THE INVENTION

Figure 1:
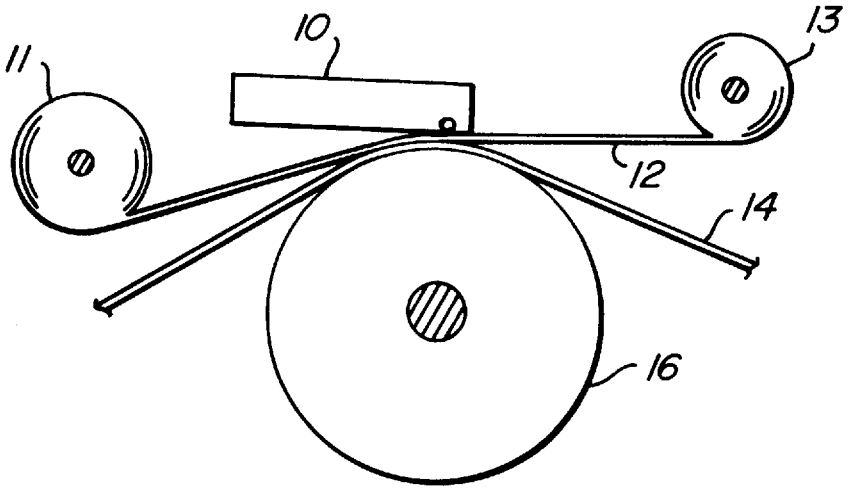
FIG. 1 is a diagrammatic view of a conventional resistive head thermal printing system.
Figure 2:
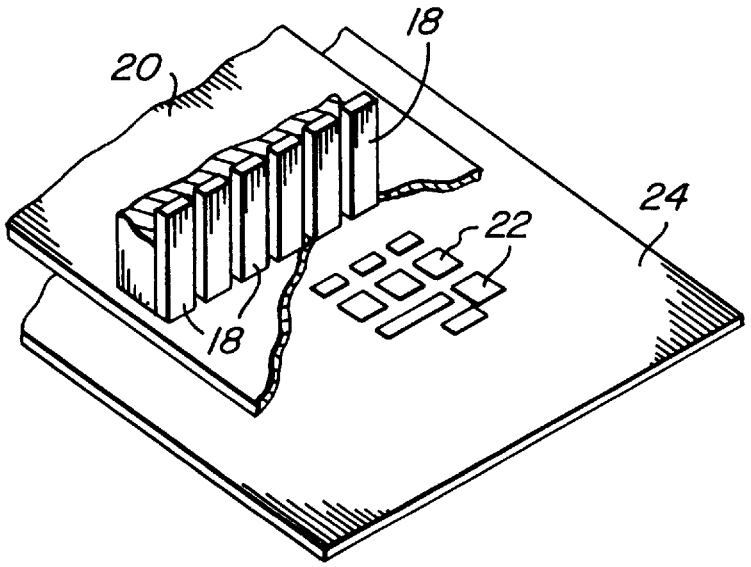
FIG. 2 is a perspective diagrammatic view of a resistive ribbon thermal printing system.
Figure 3:
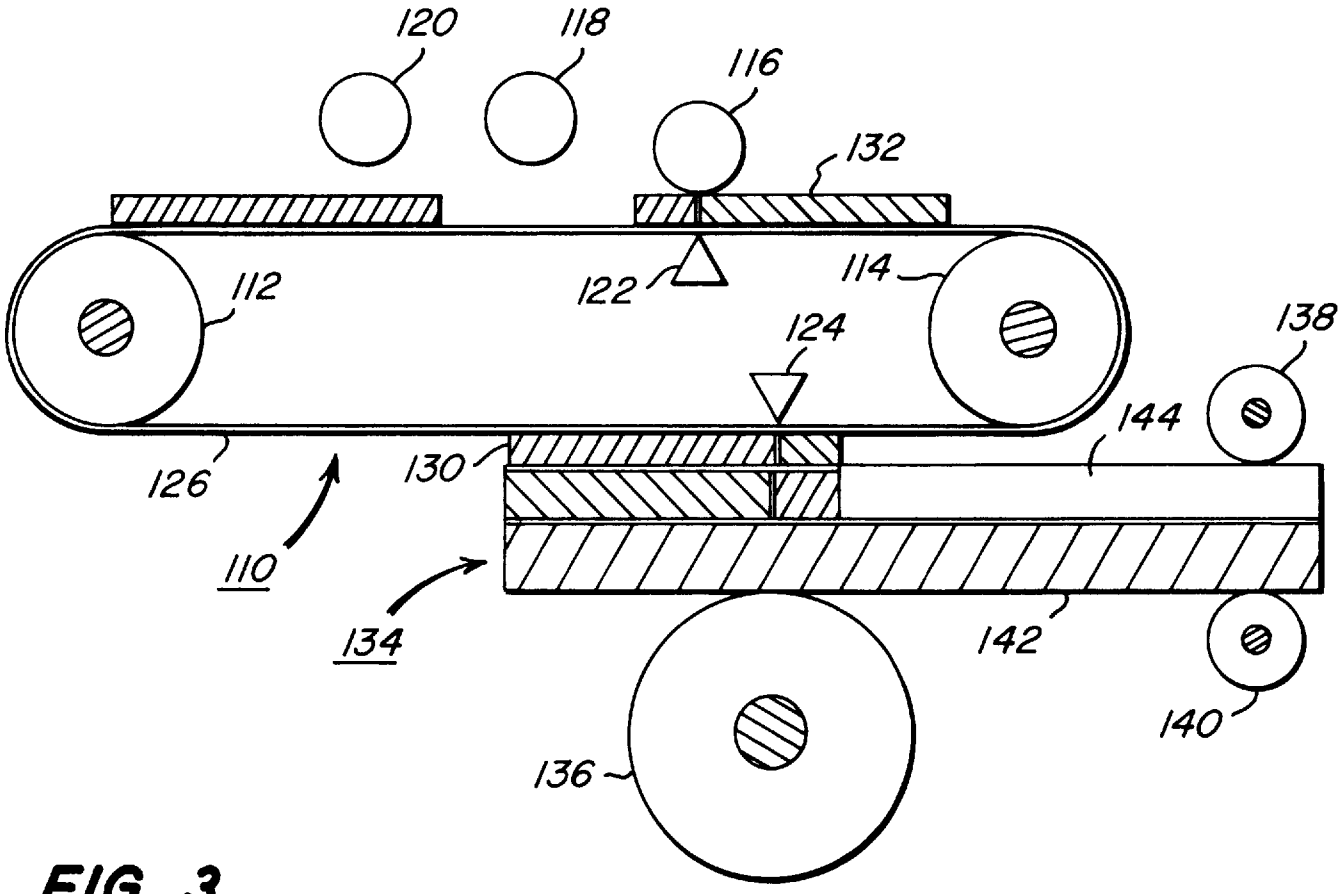
FIG. 3 is a diagrammatic side view of a reusable dye donor element and thermal printing system.

Referring to FIG. 3, there is shown a reusable dye donor element, such as in the form of a belt 110 that is trained about a pair of rollers 112 and 114. At least one of the two rollers is driven to advance belt 110 past a plurality of dye reservoir rollers 116, 118, and 120; one or more re-ink heads 122; and a printhead 124 at a printing station.

Donor member belt 110 comprises a support 126 and a dye donor element such as a plurality of dye donor patches 128, 130, and 132. Any material can be used as the support for the dye-donor element of the invention provided it is dimensionally stable and can withstand the heat generated. Such materials include aluminum or other metals; polymers loaded with carbon black; metal/polymer composites such as polymers metalized with 500–1000 Å of metal; polyesters such as polyethylene terephthalate, polyethylene naphthalate, etc.; polyamides (such as nomex); polycarbonates; cellulose esters such as cellulose acetate; fluorine polymers such as poly(vinylidene fluoride) or poly (tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 $\mu$m to about 200 $\mu$m and may also be coated with a subbing layer, if desired, such as those materials described in U.S. Pat. Nos. 4,695,288 or 4,737,486.

In the illustrated embodiment, the dye donor element forms a distinct dye donor patch on the support for each color. However, a continuous dye donor element over the entire support surface may be used, with machine logic subdividing the single element into dedicated color regions. Likewise, more than three patches may be used. The dye donor element is described below with respect to FIG. 4.

A conventional dye receiver medium 134 is drawn through a nip formed between printhead 124 and a platen roller 136 by a capstan drive roller pair 138 and 140. Dye receiver medium 134 is conventional, and includes a support 142 and a receiving layer 144. Image-wise activation of linear printhead 124 causes dye to be transferred from the dye donor element of belt 110 into the dye receiving layer 144 of medium 134; at least partially image-wise depleting portions of the patches of dye.

Dye reservoir rollers 116, 118, and 120 include a permeation membrane. Examples of membrane material include cellulose and derivatized cellulose used alone or blended with other components, polyesters, polyamides, polysulfone, crosslinked polystyrene, phenol/formaldehyde resin and fluorinated polymers to include polytetrafluoroethuylene and polyvinylidene fluoride, polycarbonate, poly (vinyl alcohol) and silicon containing polymers. Membranes can be constructed from a dense layer of polymer supported on a porous sub-layer. These polymeric membranes can be crosslinked to further reduce permeability.

Dye reservoir rollers 116, 118, and 120 may be replaced by wicks formed of similar materials, but not mounted for rotation.

Each dye reservoir roller is opposed by a re-ink head 122 (only one head is illustrated in the drawing), and the rollers are selectively raised and lowered into contact with belt 110 as necessary. When a dye reservoir roller is lowered to the belt, and the associated re-ink head activated, heat and/or pressure between the dye reservoir roller and belt 110 effects re-inking of the dye donor element, and the depleted dye donor layer of the patch is re-saturated with dye from the dye reservoir roller.

In this method, dye is thermally transferred from a reservoir to the depleted donor patch. The dye and a carrier are contained in the reservoir. The reservoir is covered with a diffusion controlled permeation membrane. With the addition of heat dye diffuses through the membrane and is delivered to the donor patch. The dye partitions between the reservoir and the donor patch reestablishing the original dye concentration.

Figure 4:
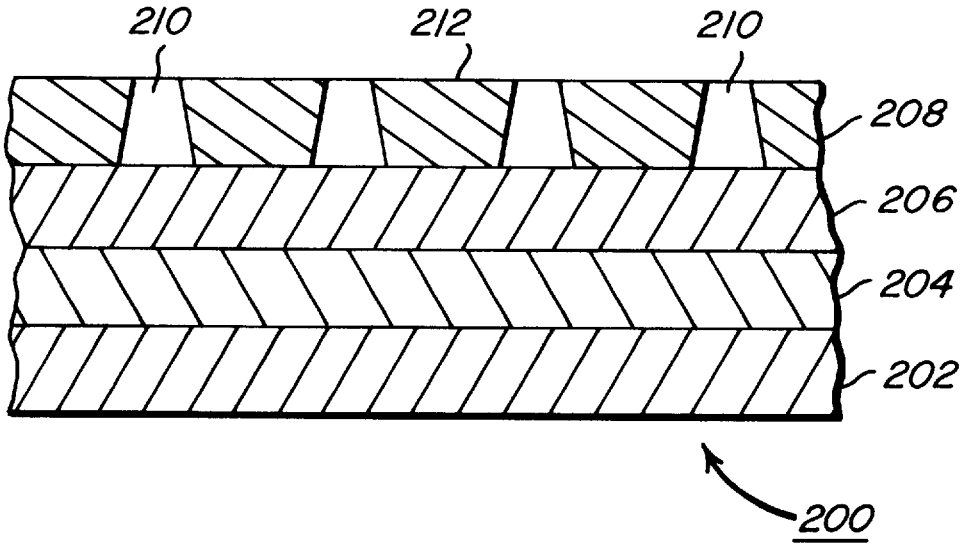
FIG. 4 is a diagrammatic side view of a segment of the dye donor element of FIG. 3.

FIG. 4 shows the structure of the dye donor element according to the invention. As shown, dye donor element 200 includes 1. A slip layer 202,
2. A base film (such as polyimide) 204,
3. An under-layer 206, and
4. A pore layer 208 having wells 210.

In one embodiment, using an oil based dye formulation, the under-layer 206 is a very thin layer of oleophilic material. The thickness of the pore layer 208 is that necessary to act as a well for the resulting design, and pore layer material is oleophobic.

In another embodiment, the alternate situation is where the dye formulation is water based and the top surface of the under-layer 206 is wetted by water (oleophobic) and the surface of the pore layer 208 is not wetted by water (oleophobic).

The under-layer 206 may be metal, metal oxide, or polymer. It can provide the current return path for a resistive ribbon printing system. The pore-layer 208 is a polymer that has wells 210 formed through it to expose the surface of layer 206. It is preferably a hard wearing surface, that can be coated and is initially non cross-linked, and can have holes formed through it, and then heated to cross link it. Alternatively, the pore material 208 may be a UV curable system and after the well formation, is cross-linked by UV radiation;

Methods of forming the wells 210 in pore material 208 include:

a) laser ablation down to the surface of layer 206, which should be chosen to be non-absorbing by the laser beam wave length.

b) the pore layer surface 212 can be coated with photoresist and exposed to arrays of wells through masking, through which chemical attack forms holes in the pore layer 208, and the photoresist in subsequently removed. It is possible that layer 208 itself could be photoresist, which after well formation through it, can be heat or UV cross linked to form a wear resistant surface.

The dimensions of the well can be controlled by the pore-layer 208 thickness, and well diameter. The degree of surface tension from well capillary action and surface wetting at the well bottom is controlled by the diameter of the well, these must be balanced against the dye properties to attract sufficient dye into the wells in layer 208. The well pitch can be determined from dye requirements for printing.

The invention has been described in detail with particular reference to certain preferred embodiments thereof, but it will be understood that variations and modifications can be effected within the spirit and scope of the invention.

PARTS LIST

| PARTS LIST | |
|---|---|
| 10 | print head |
| 11 | donor supply |
| 12 | donor sheet |
| 13 | donor take-up |
| 14 | receiver material |
| 16 | platen roller |
| 18 | electrodes |
| 20 | donor ribbon |
| 22 | ink |
| 24 | receiver |
| 110 | donor member belt |
| 112, 114 | rollers |
| 116, 118, 120 | dye reservoir rollers |
| 122 | re-ink heads |
| 124 | printhead |
| 126 | support |
| 128, 130, 132 | dye donor patches |
| 134 | dye receiver medium |
| 136 | platen roller |
| 138,140 | capstan drive roller pair |
| 142 | support |
| 144 | receiving layer |
| 200 | dye donor element |
| 202 | slip layer |
| 204 | base film |
| 206 | under-layer |
| 208 | pore layer |
| 210 | wells |
| 212 | pore layer surface |

What is claimed is:

1. A reusable thermal dye donor element for a dye transfer thermal printer comprising:

a base layer; and a donor layer on said base layer, said donor layer having a plurality of wells which preferentially adsorb and desorb dye into said wells; wherein said donor layer includes an underlayer of metal, metal oxide, or polymer and a pore layer having said wells therein.

2. The donor element of claim 1 wherein said donor layer has a contacting surface and said wells have a bottom surface, wherein said dye is an oleophilic dye, wherein said contacting surface of said donor layer is oleophobic and said bottom surface of said wells is oleophilic.

3. The donor element of claim 1 wherein said dye is an oleophobic dye, wherein said contacting surface of said donor layer is oleophilic and said bottom surface of said well is oleophobic.

4. The donor element of claim 1 wherein said donor layer is on one side of said base layer and includes a slip layer on the other side of said base layer.

5. The donor element of claim 1 wherein said base layer forms the bottom surfaces of said wells.

6. The donor element of claim 1 wherein said donor layer includes an inner donor layer forming the bottom surfaces of said wells and an outer donor layer containing said wells.

7. The donor element of claim 6 wherein said inner donor layer is of metal or metal oxide.

8. The donor element of claim 7 wherein said metal or metal oxide is suitable for magnetic recording.

9. The donor element of claim 1 wherein said base layer is electrically conductive.

10. A thermal dye transfer printing system comprising:

a reusable thermal dye donor element including a base layer and a donor layer on said base layer, said donor layer having a plurality of wells which preferentially adsorb and desorb dye into and out of said wells;

a printing station at which dye is image-wise transferred from said dye donor element to a receiver medium, at least partially depleting the dye donor element of dye; and a dye replenishment station for replenishing dye which has been depleted from said donor element wells; wherein said donor layer includes an underlayer of metal, metal oxide, or polymer and a pore layer having said wells therein.

11. The system of claim 10 wherein said donor layer of said reusable thermal dye donor element has a contacting surface and said wells have a bottom surface, wherein said dye is an oleophilic dye, wherein said contacting surface of said donor layer is oleophobic and said bottom surface of said wells is oleophilic.

12. The system of claim 10 wherein said donor layer of said reusable thermal dye donor element has a contacting surface and said wells have a bottom surface, wherein said dye is an oleophobic dye, wherein said contacting surface of said donor layer is oleophilic and said bottom surface of said wells is oleophobic.

13. The system of claim 10 wherein said reusable thermal dye donor element is a continuous belt and including a drive for continuously moving said belt in a path past said printing station and said dye replenishment station.

* * * * *